US006431070B1

(12) United States Patent
La Mura

(10) Patent No.: US 6,431,070 B1
(45) Date of Patent: Aug. 13, 2002

(54) ELECTRICAL CONNECTOR FOR USE WITH PYROTECHNIC IGNITION APPARATUS

(75) Inventor: Joseph L. La Mura, West Caldwell, NJ (US)

(73) Assignee: Joanell Laboratories, Inc., Livingston, NJ (US)

( * ) Notice: Subject to any disclaimer, the term of this patent is extended or adjusted under 35 U.S.C. 154(b) by 0 days.

(21) Appl. No.: 09/904,691

(22) Filed: Jul. 12, 2001

(51) Int. Cl.[7] ..... F42C 19/12
(52) U.S. Cl. ..... 102/202.11; 42/84; 102/355
(58) Field of Search ..... 42/84; 102/202.11, 102/355; 89/28.05

(56) References Cited

U.S. PATENT DOCUMENTS 3,228,333 A * 1/1966 Phelps et al. ..... 102/46
3,563,177 A * 2/1971 Ritchey ..... 102/38
3,777,387 A * 12/1973 Ritchey ..... 42/84
4,350,096 A * 9/1982 Cannavo et al. ..... 102/209
4,951,570 A 8/1990 La Mura et al.
5,138,948 A 8/1992 La Mura et al.
5,157,222 A * 10/1992 La Mura et al. ..... 102/355
5,450,686 A 9/1995 La Mura et al.
5,485,786 A * 1/1996 Hesse et al. ..... 102/202.5
5,559,303 A * 9/1996 La Mura et al. ..... 89/28.05
5,585,595 A 12/1996 Dix
5,589,655 A * 12/1996 Gaulmier ..... 89/1.814
6,237,273 B1 * 5/2001 La Mura et al. ..... 42/84

* cited by examiner

*Primary Examiner*—Charles T. Jordan
*Assistant Examiner*—Bret Hayes
(74) *Attorney, Agent, or Firm*—William Squire

(57) ABSTRACT

An electrical connector device for use with a pyrotechnic ignition apparatus having a magazine for igniting a plurality of devices in an array in an ignition sequence includes a plastic tube mounted in a metal cap casing to which first and second electrically isolated terminals are attached, the terminals being located in the tube chamber and extending to the casing exterior. A wire is connected to each terminal at one wire end and to a terminal attached to a plastic end cap at an end of the plastic tube opposite the metal casing. The end cap is attached to a further tube mounted telescopically inside the plastic tube. A connector is attached to the end cap terminals. The connector device is of generally the same construction at its casing terminals as the pyrotechnic devices so as to be placed in the magazine in place of a pyrotechnic device and responsive to a generated ignition signal. A remote pyrotechnic device is attached by a cable to the end cap connector. When the array of devices are ignited, the connector device receives the ignition signal applied thereto and transfers the signal to and automatically ignites the remote device in a predetermined part of the sequence.

20 Claims, 8 Drawing Sheets

ELECTRICAL CONNECTOR FOR USE WITH PYROTECHNIC IGNITION APPARATUS

This invention relates to connectors for use with pyrotechnic simulation systems and devices in which an array of pyrotechnic devices are sequentially ignited for selectively producing smoke, flash and/or noise for simulating weapon firing and hits.

Of interest are commonly owned U.S. Pat. Nos. 5,157,222 ('222) disclosing a pyrotechnic ignition apparatus and 5,138,948 and 4,951,570 disclosing a pyrotechnic device useful with the pyrotechnic ignition apparatus and incorporated in their entirety by reference herein.

Military training involves the use of pyrotechnic simulation systems employing apparatus and devices similar to the apparatus and devices disclosed in the aforementioned patents. In such systems, a laser beam is activated by a fired weapon such as a tank gun and the like. A simulation system may be located at the firing weapon such as a tank for igniting a simulation device instead of an actual ammunition round to simulate the firing of the weapon. The laser beam is directed to a target being fired upon. A receiver at the target senses the received laser beam and ignites a pyrotechnic device associated with the ignition apparatus at the target simulating a hit, a near hit and the like.

The ignition apparatus has a magazine with a plurality of pyrotechnic devices which may be similar to 8 gauge shot gun shells in size. The magazine is associated with an ignition control system. The devices are ignited sequentially by the control system in response to successive firings or hits. All of these pyrotechnic devices are releasably mounted in the magazine so that the magazine can be periodically reloaded.

In some training environments, missiles or other pyrotechnics are used to simulate other conditions than that of the pyrotechnic devices associated with the ignition apparatus. These missiles and other pyrotechnics are not used with the ignition apparatus described above and in the aforementioned '222 patent. Therefore, to fire the missiles or other pyrotechnics requires separate firing devices and control systems. However, these missiles and pyrotechnics are intended to be used in conjunction with the flash, smoke and noise devices as described in the aforementioned patents. Various training sequences sometimes requires the missiles and other pyrotechnics to be fired within the sequence of the ignition of the pyrotechnic devices employed with the ignition apparatus of the '222 patent. This requires a manual timing of the ignition of the missile, which timing is difficult.

A need is seen therefore for a way to ignite such missiles automatically in the sequence of the flash, smoke, and noise pyrotechnic rounds fired by the ignition apparatus of the '222 patent Such missiles are located remotely from the ignition apparatus, for example 100's of yards to kilometers distance from the ignition apparatus located at a primary target and are typically independent of the ignition apparatus of the type described in the aforementioned patent '222. The present invention is directed to providing a solution to this problem so that the missile firings are integral with and automatically initiated as part of the ignition of the devices associated with the ignition apparatus.

A pyrotechnic ignition signal transfer connector device according to the present invention is for use with a pyrotechnic ignition apparatus having first and second device ignition terminals. The device comprises a housing having first and second opposing ends and a chamber. Third and fourth electrically conductively isolated terminals are connected to the housing first end, each terminal for respective engagement with a different one of the pyrotechnic ignition apparatus first and second terminals. Fifth and sixth electrically conductively isolated electrical terminals are secured to the housing second end, the fifth terminal being electrically conductively connected to the third terminal and the sixth terminal being electrically conductively connected to the fourth terminals.

In one aspect, the housing is thermoplastic.

In a further aspect, the first end includes a metal cap.

In a further aspect, a cap encloses the housing chamber at the second end.

In a still further aspect, the housing chamber is defined by a side wall and a bottom wall, the device including a cap enclosing the chamber at the housing chamber second end, the cap including a sleeve telescopically received in the chamber, and means for securing the cap to the housing.

In a further aspect, the sleeve overlies the housing at a side wall of the chamber, the means for securing including a fastener attached to the sleeve and housing.

In a still further aspect, the fifth and sixth terminals comprise studs, each stud having a bore for receiving one of a seventh and eighth terminals therein for connection to a remote pyrotechnic device for igniting that remote device with an ignition signal, and a means for attaching a corresponding stud to the housing.

In a further aspect the housing chamber at the second end is enclosed by a cap, the studs each being attached to the cap.

In a further aspect, the housing is tubular with the first end enclosed, the third and fourth terminals passing through the enclosed first end.

A method of making the device according to a further aspect comprises forming a tubular housing of thermoplastic material with at least one opening in the housing first end, forming the third and fourth terminals, attaching a first electrical conductor to the third terminal and a second electrical conductor to the fourth terminal, passing the first and second electrical conductors and a portion of the third and fourth terminals through said housing opening into the chamber, securing the third and fourth terminals to the housing first end, attaching the fifth terminal to first electrical conductor distal the third terminal and the sixth terminal to the second electrical conductor distal the fourth terminal, and then securing the fifth and sixth terminals to the housing second end and enclosing the chamber at the housing second end.

In a further aspect, a pyrotechnic ignition apparatus comprises a magazine; a plurality of devices secured to the magazine; at least one first of said devices for simulating at least one of flash, smoke or noise when ignited, ignition means for receiving the magazine and for selectively igniting the secured devices individually with an associated applied ignition signal; at least one second of said devices including first terminals for receiving said ignition signal and including second terminals distal the first terminals and ohmically connected to the first terminals for transferring the ignition signal to the second terminals.

In a still further aspect, a further device is included and includes third terminals arranged to be remotely positioned relative to said magazine, the further device including conductor means for ohmically connecting the third terminals to the second terminals, the third terminals being arranged to releasably mate with and electrically couple to the second terminals for applying said ignition signal to said further device.

A method of forming an electrical connection device according to a further aspect comprises forming a tubular housing with a chamber and opposing ends, the housing having a bottom wall and an annular side wall, the bottom wall being at one end of the housing and having at least one through opening in communication with the chamber; forming first and second terminals; attaching a first electrical conductor to the first terminal; attaching a second electrical conductor to the second terminal; passing the first and second electrical conductors through the at least one through opening into the chamber; securing the first and second terminals to the housing bottom wall in said at least one opening; forming a cap for enclosing the chamber; attaching third and fourth terminals to the cap, the third and fourth terminals passing through the cap in communication with opposing cap sides, the third and fourth terminals for being ohmically connected to an electrical connector; ohmically coupling the first electrical conductor to the third terminal and ohmically coupling the second electrical conductor to the fourth terminal; and attaching the cap to the housing over the chamber end opposite the bottom wall with the third and fourth terminals in communication with the chamber and ambient atmosphere.

An electrical connector for receiving and transferring an electrical signal applied to first and second terminals according to a further aspect comprises a tubular housing having first and second opposing ends, a bottom wall at the first end and a chamber; third and fourth electrically conductively isolated terminals connected to the housing bottom wall in communication with the chamber, each terminal for respective releasable engagement with a different one of and mating with the first and second terminals for receiving the applied electrical signal; a first conductor connected to the third terminal and located in the chamber and a second conductor connected to the fourth terminal and located in the chamber, a cap enclosing the housing second end; fifth and sixth electrically conductively isolated electrical terminals secured to the cap and passing through the cap, the fifth terminal being electrically conductively connected to the first conductor and the sixth terminal being electrically conductively connected to the second conductor whereby the electrical signal is applied to the fifth and sixth terminals externally the cap.

IN THE DRAWING

Figure 1:
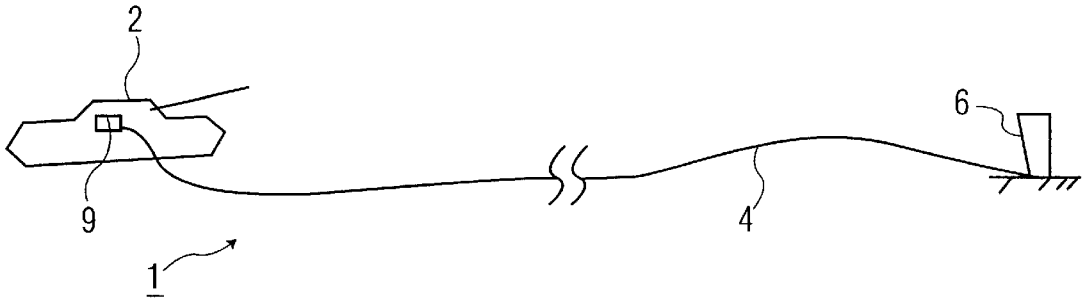
FIG. 1 is a schematic diagram of a system according to an embodiment of the present invention.

In FIG. 1 a pyrotechnic ignition system 1 comprises a target 2 which may a simulated tank or a real combat tank. Attached to the target 2 is a pyrotechnic ignition apparatus 10. The apparatus 10 is part of a training system (not shown) in which a firing weapon emits an electronic beam such as a laser or radio frequency signal, for example, aimed at whatever the weapon is aimed at. A receiver (not shown) at the target receives the emitted signal when the weapon is aimed correctly when fired. When the emitted signal is correctly aimed, it is received by the receiver which generates a fire command signal which is applied to the apparatus 10. The apparatus 10 is loaded with an array of pyrotechnic devices 24, FIG. 3. This array of devices comprise pyrotechnic material which when ignited emit flash, smoke and/or noise depending upon the nature of the pyrotechnic material stored in each device. The smoke may also be colored to manifest a certain kind of hit The flash or noise are also arranged to manifest a certain kind of hit such as a minor hit or a kill hit which is intended to manifest that the target is disabled.

An electrical connector device 25, FIGS. 3 and 5–7, according to the present invention, is assembled to the magazine 16 for ignition in a predetermined sequence with the ignition of the devices 24. When the device 25 receives an ignition signal it connects the signal via cable 4, FIG. 1, to a remote pyrotechnic device 6 such as a missile or other type of device. This sequence of events with a remote pyrotechnic being ignited in a sequence with the devices 24 adds to the realism of the training exercise.

Figure 2:
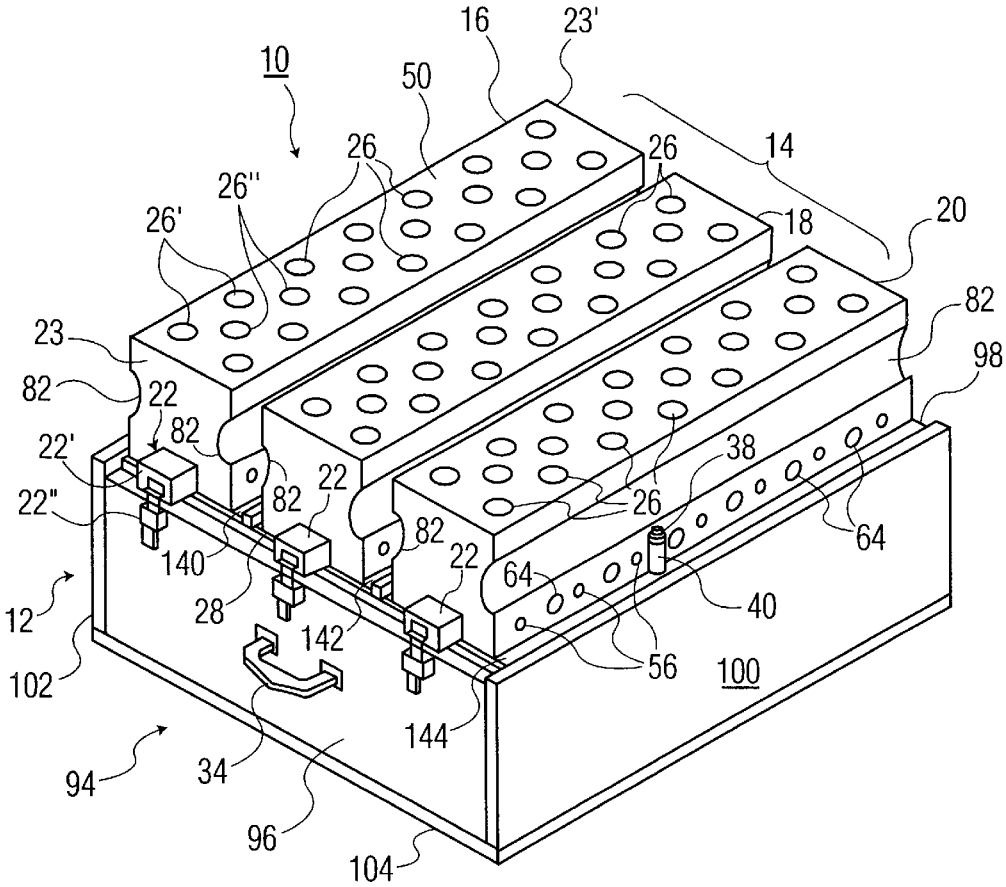
FIG. 2 PRIOR ART
FIG. 2 is an isometric view of a prior art pyrotechnic ignition apparatus depicted in the embodiment of FIG. 1.

In FIG. 2, the pyrotechnic ignition apparatus 10 is fully described in the aforementioned '222 patent incorporated by reference herein. Reference should be made to that patent for details on the firing circuit and further details on the apparatus construction. The description herein is given by way of example of this apparatus and other apparatuses may also be used with the connector device 25, such as shown in U.S. Pat. No. 5,585,595 to Dix available from Diehl in Germany.

The apparatus 10 includes a fire control box and support assembly 12. Secured thereto is an array of magazines 16,18 and 20. Each magazine, for example, magazine 16, is secured to the support assembly 12 at each end by a latch assembly 22. The latch assembly 22 comprises a hook assembly 22' attached to the end of magazine 16 and a loop assembly 22" attached to the support assembly. A latch assembly is at each end 23 and 23' of the magazine. Latch assemblies 22 are attached in similar fashion to each end of magazines 18 and 20 for securing the magazines 16, 18 and 20 of the array 14 to the support assembly 12 on plates 140, 142 144, respectively, which form displaceable platforms. Latch assemblies 22 are all identical and perform similar functions in not only securing the magazine to the support assembly 12, but also cause the pyrotechnic devices 24 and connector device 25 mounted in a magazine to be electrically ohmically contacted to the circuit (not shown)in the fire control box and support assembly 12.

Representative magazine 16 includes an array of 20 receptacles 26. The pyrotechnic devices 24 and connector 25 may be 8 gauge shot gun shells of foreshortened length closely received in the mating receptacles. The exterior shape and dimensions of the devices 24 and connector 25 are substantially the same so as to be interchangeably secured in any of the receptacles 26.

Figure 3:
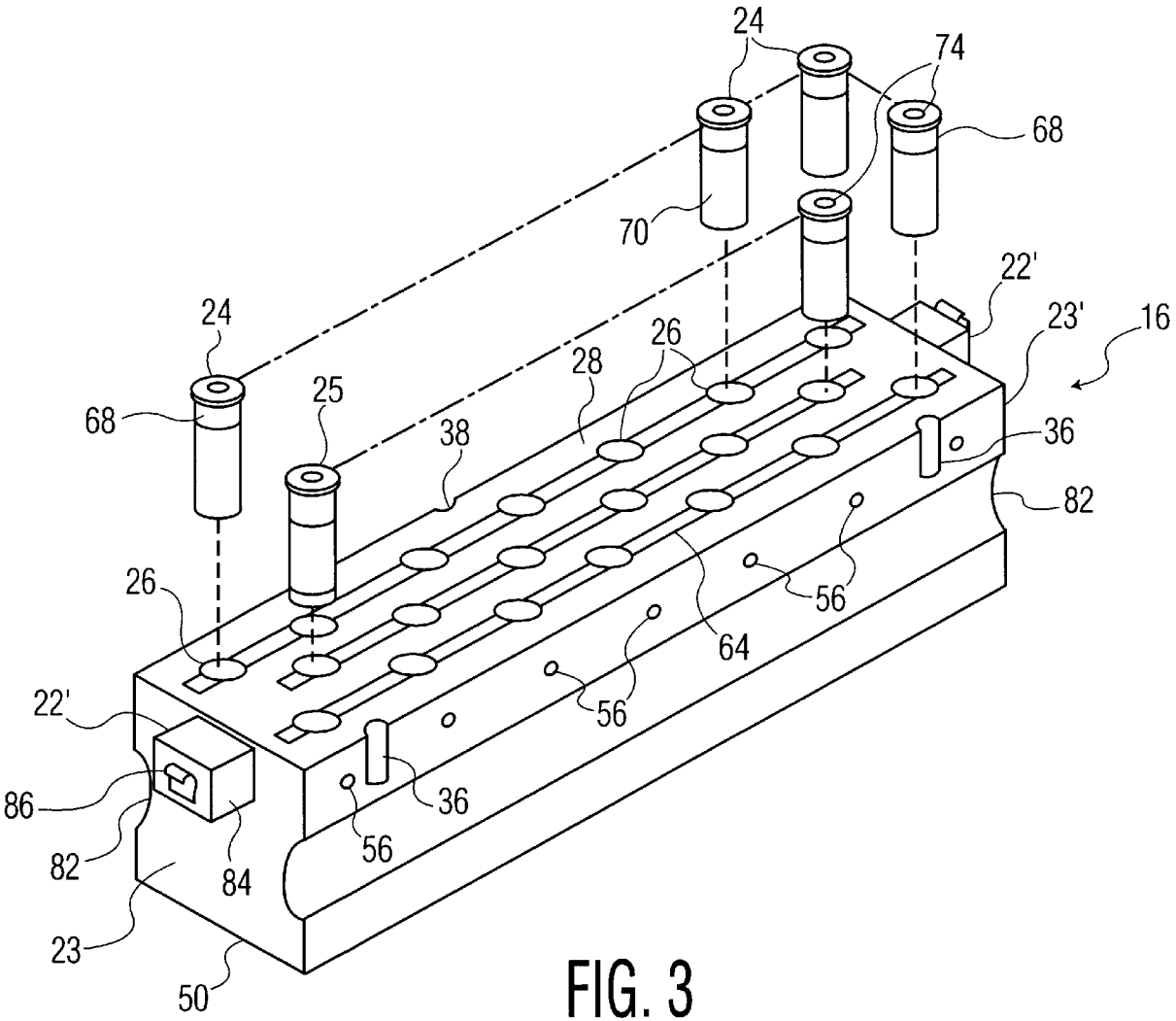
FIG. 3 is a rear isometric view of one of the magazines of FIG. 2.

The devices 24 and connector device 25 are inserted into the upside down magazine 16 via the bottom surface 28, FIG. 3. The magazine is then inverted to the position of FIG. 2 and latched to the support assembly 12 by latch assemblies 22 which thus also lock the devices 24 and connector 25 temporarily in place. The latches are cam devices which move the magazine during the latching to positively engage the contacts on the support assembly as will be explained. The support assembly 12 includes a resiliently supported metal platform formed by plate 140, FIG. 4, on which each magazine rests and which may form a ground contact for the received pyrotechnic devices and connector 25. This plate 140 displaces in response to and during latching. In the reverse procedure, unlatching the magazine 16 and removal of the magazine from the support assembly 12 and inverting to the position of FIG. 3 permits spent devices 24 to be unloaded and fresh devices to be loaded onto the magazine. The connector device 25 remains in the magazine or may be moved to a different position or removed as desired for a given training sequence.

The magazines may all have receptacles of the same diameter, different diameters or the receptacles of one magazine may have receptacles of the same or different diameters as desired for a given implementation. The receptacles also may be of different lengths to accommodate pyrotechnic devices and connector devices of corresponding different lengths. The receptacles of each magazine have center lines that align with corresponding center lines of the mating contacts 132 (FIG. 4) associated with the platform 140 of the support assembly 12 so that the devices mounted in the different receptacles mate with those corresponding aligned contacts. The magazines 16, 18, and 20 are interchangeable with each other so that devices mounted in the receptacles 26 all will mate with the associated contacts. However, the magazines may be the same or different in respect of the receptacle dimensioning.

The magazines each include guide slots 36, 38 (FIG. 3) that mate with corresponding guide pins 40 extending from the assembly 12. In the alternative, the magazines may be hinged to the assembly 12 as shown in the aforementioned Dix patent. The mating guide slots and pins assure alignment of the contacts on assembly 12 with the magazine receptacles 26. Each magazine has a separate individual corresponding moving platform 140 and guide pins associated thereto. In the alternative, the support assembly may be arranged to receive only one magazine rather than the three shown. Each support assembly and magazine would be operative similarly as the apparatus 10 except a maximum of 20 pyrotechnic devices 24 and connectors 25 are associated therewith rather than the 60 devices associate with the three magazines of assembly 12.

Figure 4:
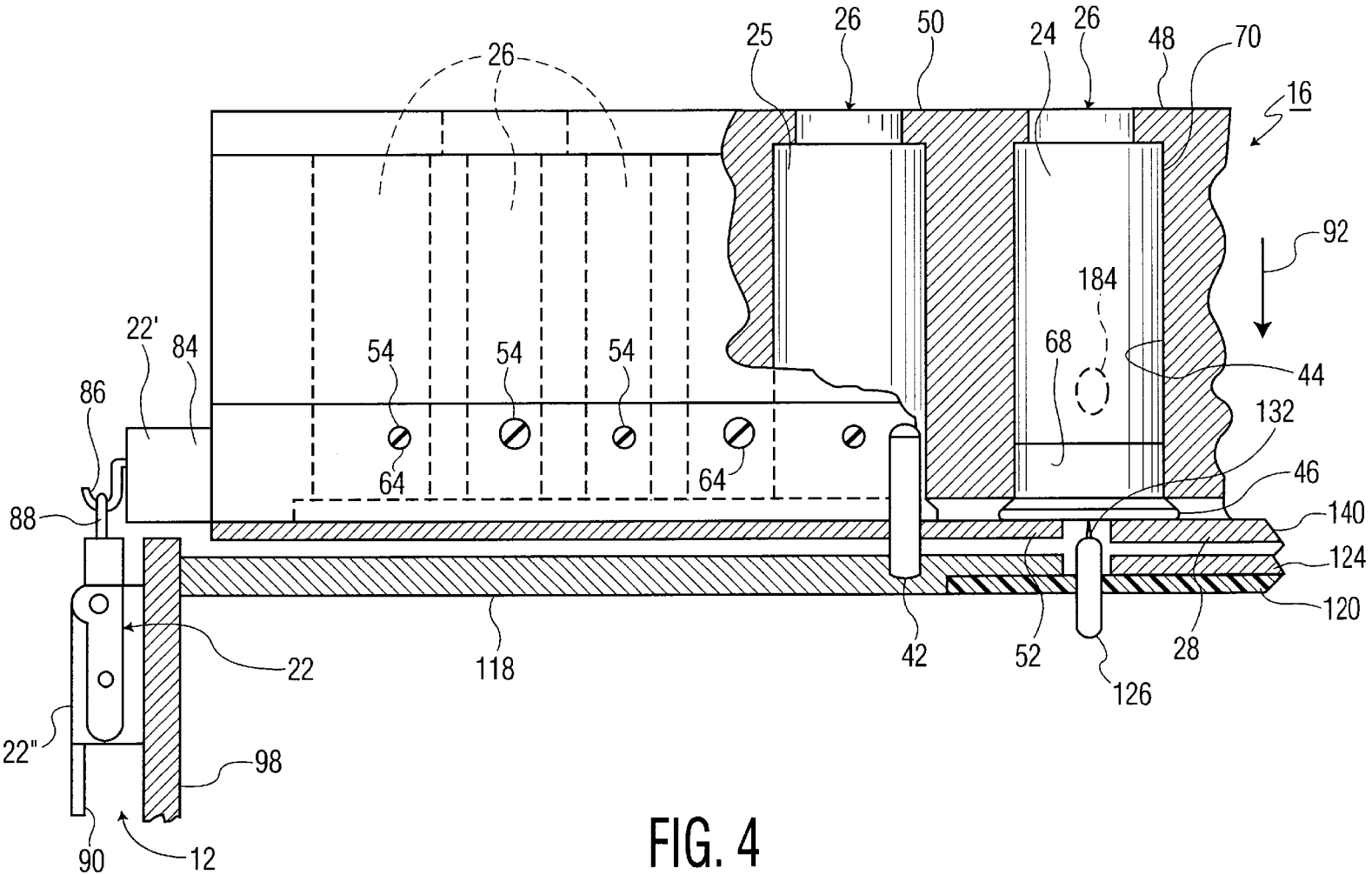
FIG. 4 is a fragmented sectional elevation view of the apparatus of FIG. 2 taken between the magazines with a partial sectional elevation view of one of the magazines.

In FIG. 4, a typical receptacle 26 includes a bore 44, an enlarged shoulder 46 and an inwardly depending flange 48 at top surface 50. The device 24 and connector 25 are foreshortened conventional eight gauge shot gun shells so as to fit within the bore 44 of a length established by flange 48. This foreshortening prevents commercial eight gauge shells from being used in the magazines. The devices 24 and connector device 25 terminate at the activating end in an annular flange 52. Flange 52 is received in the shoulder 46. The flange is locked to the magazine by the platform 140 of the support assembly 12 and the smaller bore 44 of the receptacle. The flange 48 also locks the devices 24 and 25 in the mating bore 44. The flange 48 on the magazine is optional.

Figure 8:
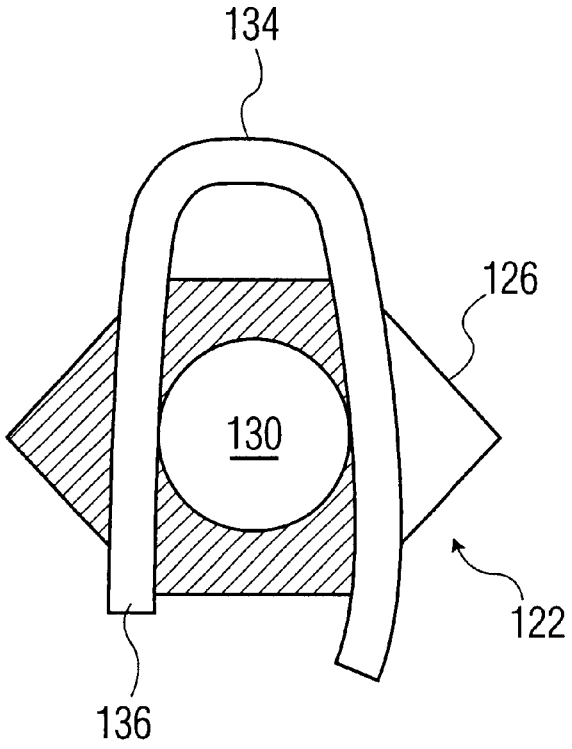
FIG. 8 is a plan sectional view of a terminal used in the device of FIG. 5.
Figure 9:
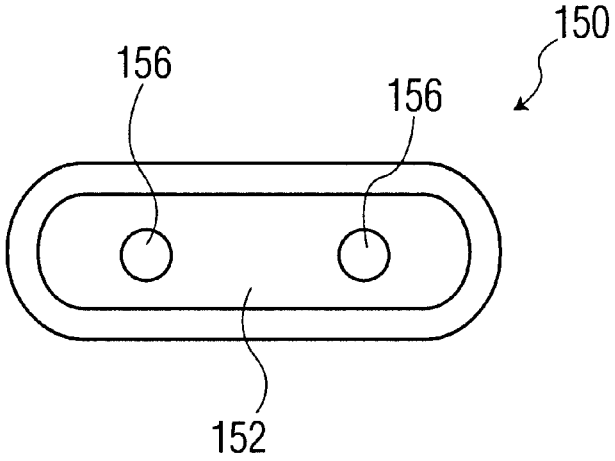
FIG. 9 is a bottom end view of the connector of FIG. 7.
Figure 10:
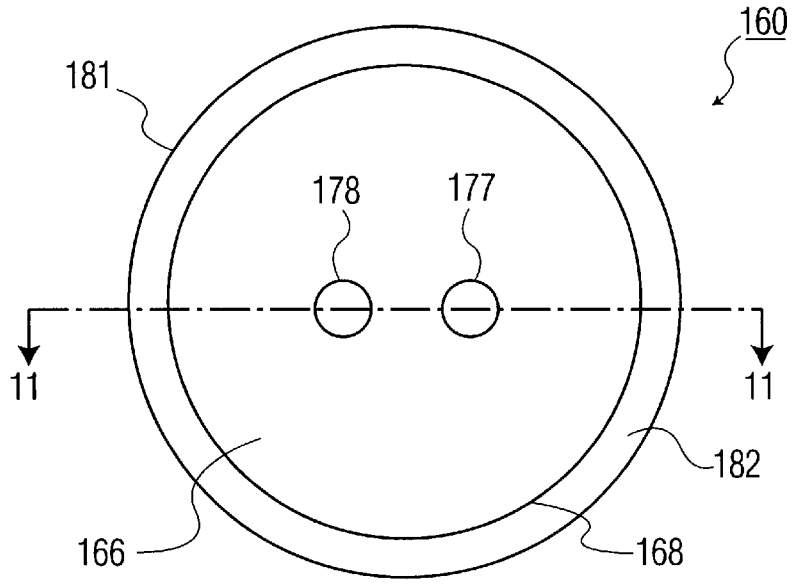
FIG. 10 is a bottom plan view of a device according to a further embodiment.

A plurality of detent assemblies 54 may be used to secure the devices 24 and connector in the receptacles 26. Apertures 64 may be used to receive some of the detent assemblies. In the alternative, U-shaped or other shaped wire springs (not shown in the magazines but described later in connection with FIG. 8) may be inserted in corresponding grooves or apertures in the magazines and associated with each receptacle for releasably retaining a device 24 or 25 in the receptacle. In a further alternative, the springs in each receptacle may be used for providing a ground electrical connection to each device 24 or 25 ground terminal.

In FIG. 3, the magazines each include a plurality of longitudinal grooves forming recesses such as recess 64 in the bottom surface 28. These recesses enhance manual grasping of the devices 24 and connector 25 flanges 52 (FIG. 4) for removal from the magazine 16.

In FIGS. 2–4, the magazines each include a hook assembly 22' comprising a block 84 and a hook 86. The latch 22 includes a loop assembly 22". The assembly 22" has a loop 88 which engages the hook 86 and a cam mechanism (not shown) operated by latch handle 90 which when operated pulls the loop downwardly in FIG. 2 toward the bottom of the figure (direction 92, FIG. 4) pulling the magazine 16 and its support plate 140 downwardly. The loop 88 normally is loosely engaged with the hook 86 when the magazine is first mounted on the plate 140. After mounting, the latches at each magazine end are then operated to secure the magazine to the support assembly 12 and displace the magazine and support plate 140.

The pyrotechnic devices 24 and 25, FIGS. 4–7, preferably have substantially identical terminal assemblies 69 including casings 68 and tube 70, 70' constructions. Devices 24 are fabricated with insulating tubes 70 and devices 25 are fabricated with tubes 70' which are substantially the same as tubes 70 except for minor differences described below. The devices 24 and 25, however, are enclosed by respective caps that are significantly different The devices comprise a metal casing 68, FIGS. 4 and 6, and an insulated tube 70 such as molded thermoplastic which is preferred. The tube 70 has a thick portion 72 forming a bottom wall 74 of the tube 70. Portion 72 has a bore 93.

The tube 70 has a chamber 66 (FIGS. 5 and 6) that is filled with pyrotechnic material only in devices 24. A pyrotechnic detonator 184 is inside the tube 70 chamber 66 in contact with the pyrotechnic material, in respect of devices 24, but not in device 25. The detonator 184 (used with device 24 only) is an electrically operated match connected to the terminals 71 and 73 (FIG. 6) of the device 24. The terminal 71 extends from an elongated brass circular cylindrical rod 75. The rod 75 protrudes from the casing 68 at the device bottom at flange 77. The terminal 71 is of reduced cross section.

A rubber or other elastomeric electrically insulating tube 79 receives the rod 75 in the tube 79 bore 79'. The tube 79 is in the bore of the terminal tube 81. The terminal 73 extends from a circular cylindrical brass tube 81 formed at its other end with the flange 77. The rod 75 forms a central contact which engages the contact of assembly 126, FIG. 4.

Figure 5:
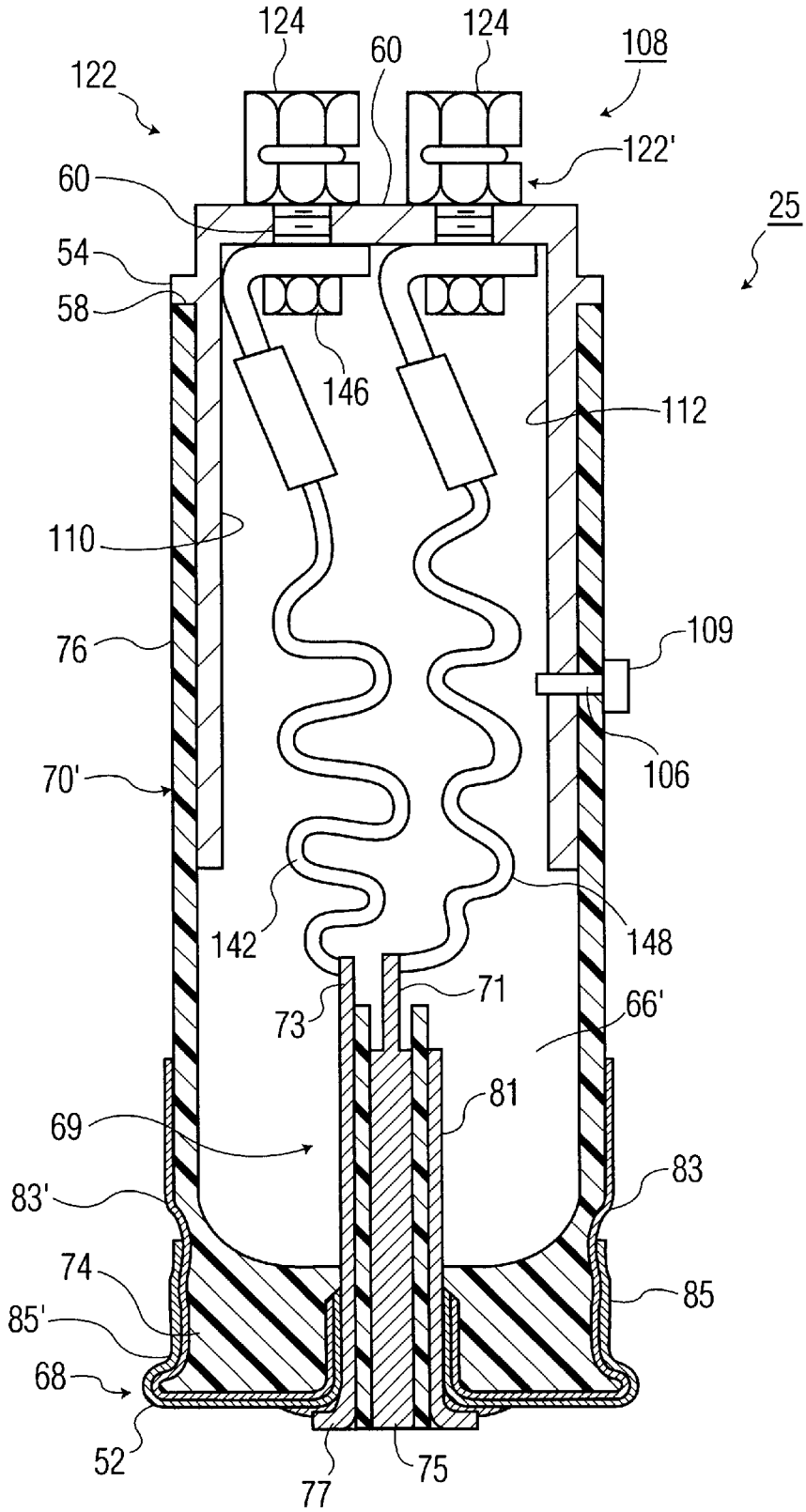
FIG. 5 is a sectional view of an electrical connector device used with the apparatus of FIG. 2 to transfer an ignition signal to the remote device in the embodiment of FIG. 1.
Figure 6:
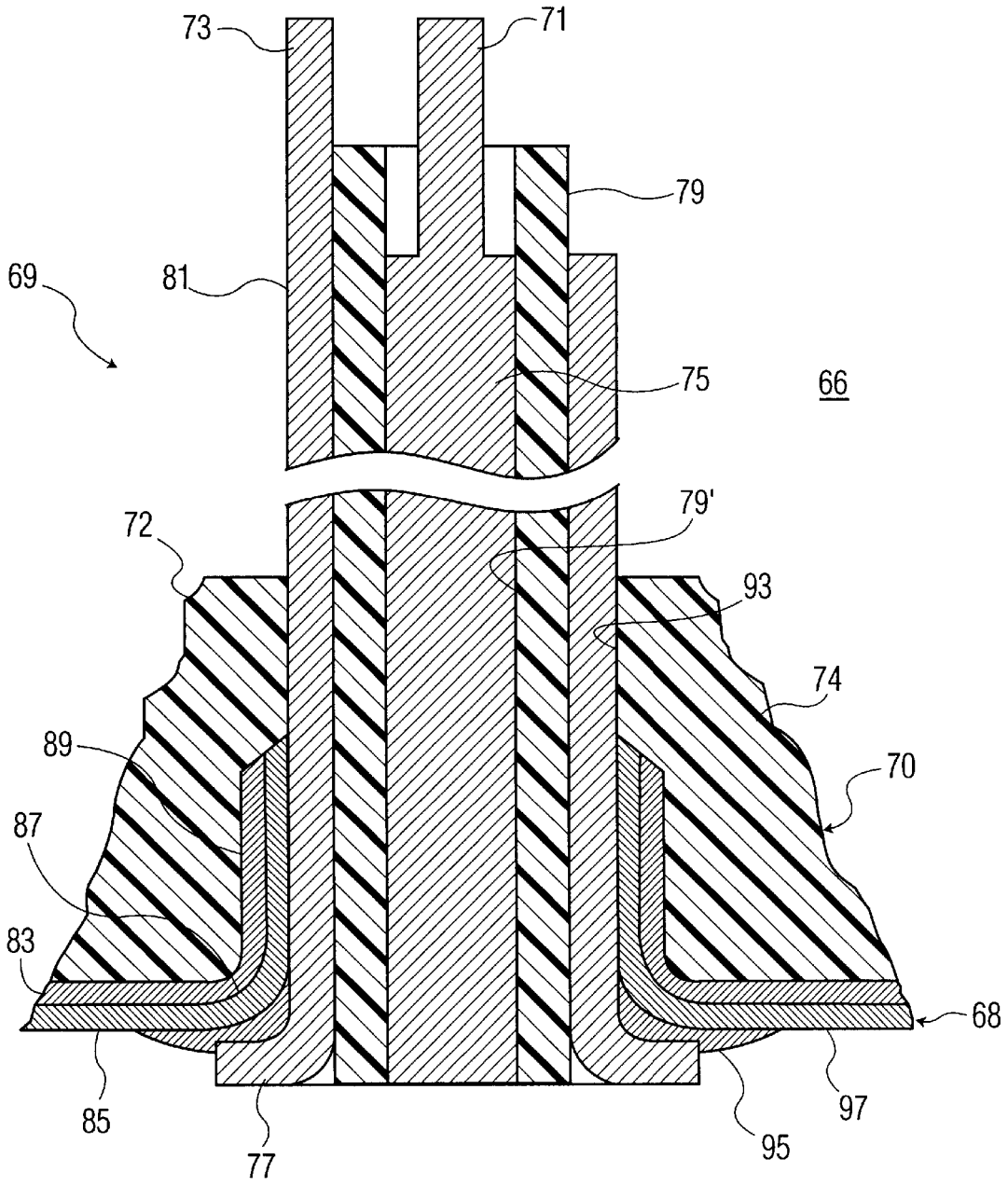
FIG. 6 is a fragmented sectional elevation view of a portion of the device of FIG. 5 showing the terminal portion in more detail.

Casing 68, FIG. 4 and 6, comprises an inner casing shell 83 and an outer casing shell 85 both made of stamped brass. Both casing shells have a radius 87 at inner concentric tubular circular cylindrical portions 89. The inner and outer shells each have respective concentric complementary shaped outer tubular circular cylindrical portions 83' and 85' (FIG. 5) receiving the tube 70 upstanding outer wall. Portion 93 is shorter than portion 91. The shells 83 and 85 are press fit to the tube 70 forming an electrical ground contact therewith. The tube 81 of terminal 73 is press fit into the tube 70 and into the casing 68 inner cylindrical portions 89. Optionally, the flange 77 of terminal tube 84 may be soldered to inner casing shell 83 by solder joint at the outer shell 85 bottom wall 97. Otherwise the parts may be pressed fit together and form a hermetic seal at the joint. The other end of the device 24 is hermetically sealed with a cap as described more fully in the '948 patent incorporated by reference herein. The other end of device 25 will be described in more detail below.

The casing 68 and terminal 73, FIG. 6, of devices 24 and 25 forms a ground terminal and the central terminal 71 in the device 24 and 25 receives an ignition signal. The ignition signal ignites the match 74 of device 24 (FIG. 4). The ignition signal is applied to the device 24 or device 25 central terminal by a contact 132 extending from contact assembly 126, FIG. 4 of support assembly 12.

The contact assembly 126 is mounted on printed circuit board 120, FIG. 4, and connected to an ignition circuit described more fully in the aforementioned pat No. '222 incorporated by reference herein. The ignition signal is applied to the different contact assemblies in a given sequence. In this sequence, all devices 24 and 25 eventually will receive the ignition signal. The timing of the generation and receipt of such signals is determined by the firing circuit described in the '222 patent. Generally the sequence is in an ordinal arrangement, but may be in other sequences. The device 25 is placed in a given receptacle based on the desired firing sequence for this device predetermined by the type of remote pyrotechnic device that is coupled to the connector device 25.

In addition, the firing sequences of each contact assembly 126 may be timed in different timing arrangements so that only a given number of devices 24 (and 25) are fired in the sequence. Further, this sequence may be arranged in such close time intervals, e.g., a fraction of a second between device ignitions, that the ignition of the entire group of devices appears to be simultaneous. This timing may be made to the disclosed circuit of pat. '222 by one of ordinary skill.

For example, if a large explosion effect is desired, all 20 devices of a magazine may be ignited within a short interval such as one second or so. If a small explosion effect is desired any fewer number of devices in a group, e.g., 2–20 or more may be ignited within the short interval of one second for example to give the appearance all devices are fired simultaneously. Each such group is ignited by a common command signal applied to the apparatus 10. See pat '222 for the use of such command signals for operating the circuit to cause the generation of an ignition signal. Each command signal manifests a given hit or firing of a weapon. The command signals generally will be spaced apart in time intervals of much greater value than a fraction of a second, for example in terms of intervals of minutes, rather than fractions of seconds, such as intervals in terms of microseconds, for all devices of a selected group to be ignited by one command signal. The circuit described in pat. '222 describes the firing of devices in different groups. The timing of the firing of devices in a group can be programmed into the CPU device described therein to be fired in fraction of second intervals as desired.

Assembly 12, FIGS. 2 and 4, comprises a housing 94 including end walls 96 and 98, side walls 100 and 102, and bottom wall 104. Handles 34 are secured to the walls 96 and 98. Switches and connectors connected to tea housing 94 for operating the circuit contained in housing 94 are not shown. In FIG. 4, a support plate 118 is secured to walls 98, 100 and 102. A latch assembly 22 is also secured to walls 96, 98. Printed circuit board 120 is secured to plate 118 in recess 124 by screws not shown. Three printed circuit boards 120 are provided each corresponding to a different support plate 140 and corresponding magazine 16, 18 and 20. The contact assemblies 126 are mounted on the corresponding printed circuit boards 120 in the corresponding desired array of the receptacles 26 of the different magazines.

The contact assemblies 126, FIG. 4, are described more fully in the aforementioned '222 patent and are in the same center to center spacing as the receptacles 26. A typical contact assembly 126 comprises a metal hollow housing, containing a compression spring (not shown) and a needle contact 132 which is resiliently mounted to the spring and extends from the housing. The contact 132 is in ohmic contact with the assembly 126 housing which in turn is coupled to the ignition circuit (not shown) by its connection to a printed circuit board 120 conductor and related connection circuitry, described in the '222 patent. The assemblies 126 pass through holes in the plate 118 to electrically isolate them from the plate and each other. The assemblies 126 are electrically isolated from each other by the board 120. The needle contacts 132 pass through corresponding apertures in the mounting plate 140 as shown in FIG. 4 when making electrical contact to the received devices 24 and 25. The needle contacts 132 ohmically engage the center terminal contact of device 24 by rod 75, FIG. 6. The plate 140 is made of metal and forms an electrical ground contact in the operating circuit (not shown) and connects the device 24 casing 68 to ground potential.

In the alternative, the casing may be connected to ground via the magazines which are metal and the guide pins 40, FIG. 2, which are in ohmic contact with the mating magazine via guide slot 38 which is bare metal for making such a contact. In addition, springs (not shown) in the magazine at each receptacle as described above may contact the casing 68 for making further ohmic coupling of the casing 68 to the magazine 16. In the latter case, the housing 94 of the support assembly 12 and the support plate 140 may be anodized to protect these elements from environmental effects, the anodizing being an electrical insulator. The magazine guide slots and mating guide pins are not anodized in this case.

Not shown are further contacts such as assemblies 126 between the plate 118 and the plate 140 for providing additional or alternative ground connections therebetween. These latter contacts may engage bared contact terminals on the plate 140 undersurface (not shown). Thus a number of different alternative ground potential connections may be used to connect the received devices 24 casings 68 to ground potential.

In FIG. 4, plate 140 displaces in direction 92 in response to the latching as described above. A plurality of resilient support plungers (not shown) resiliently mount the plate 140 to plate 118. The plungers include a housing, a spring in the housing and a ball secured to the housing (all not shown) and mounted engaged with the spring so the ball is resiliently secured to the housing. The plate 140 rests on the ball. These are described in more detail in pat No. '222.

Also, a plurality of guide devices including shoulder bolts (not shown) retain the plate 140 attached to the plate 118 and permit the plate 140 to displace relative to plate 118. These devices include a guide formed by a bore in plate 118. A threaded stud with a head is threaded to plate 140 and has a shank which is received in the bore in the plate 140 (not shown). The shank slides in the bore in plate 118 as plate 140 displaces with the stud. The head captures the plate 118 to plate 140. The contacts 132 preferably are recessed in the mating plate 140 aperture and selectively protrude therefrom to engage the devices 24 and 25 terminals when the plate is displaced as the magazine 16 is latched. This prevents damage to the contacts when the magazines are not mounted on the plate 140.

A battery not shown for operating the circuit (not shown) is also mounted to the housing 94 as are other circuit components (not shown). Reference is made to Pat. No. '222 for further details on the circuit and its manner of operation.

In FIG. 5, connector device 25 includes terminal assembly 69 described above in connection with the description of device 24. The terminal assembly 69 may be identical to both devices and may be constructed as described more fully in the aforementioned U.S. Pat. Nos. 5,138,948 and 4,951,570 incorporated in their entirety by reference herein. The tube 70' differs from tube 70 in that the tube 70' has an aperture 106 through its side wall 76 for receiving a screw 108. Otherwise the tubes 70 and 70' are of the same construction. The tube 70 has a bottom wall 74 and a side wall 76.

Figure 7:
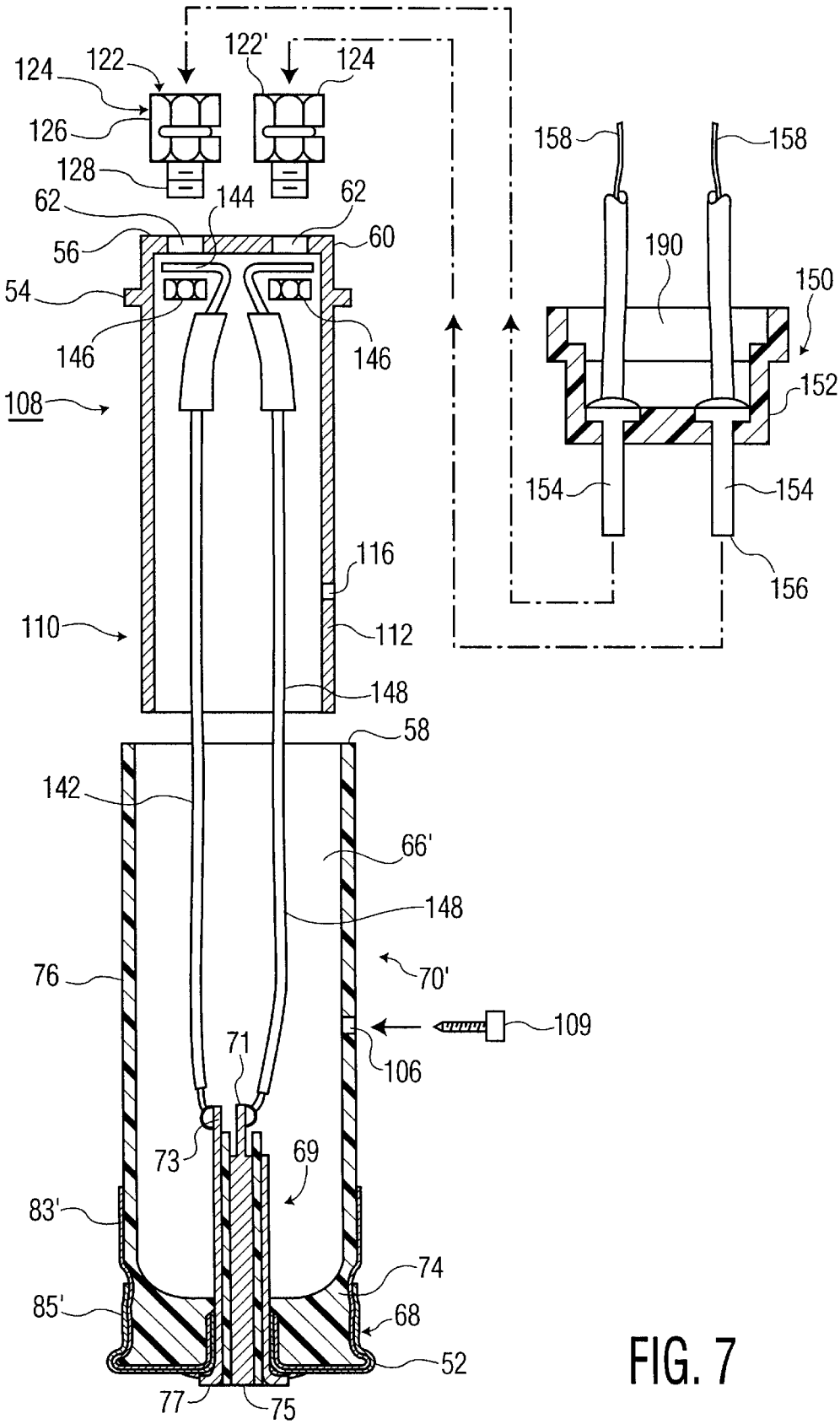
FIG. 7 is an exploded view of the device of FIG. 5 further including a connector for connecting the remote device of FIG. 1 to the device of FIG. 5.

Connector device 25, FIGS. 5–7, includes a connector assembly 108 that is attached to terminal assembly 69 and tube 70'. Connector assembly 108, FIGS. 7 and 8, includes a preferably molded thermoplastic tube 110. Tube 110 comprises an elongated tube portion 112 with a through aperture 116 for receiving screw 109. The screw 109 fastens the tube 110 in the position of FIG. 5 inside of the chamber 66' of the tube 70'. The tube portion 112 is telescopically received inside of tube 70' chamber 66' formed by side wall 76 and bottom wall 74 and preferably abuts the inner side wall surface of tube 70'.

An outer radially extending flange 54 is adjacent to end 56 of the tube 110. The flange 56 abuts the end edge 58 of tube 70', FIG. 5, when assembled thereto as in FIG. 5. In FIG. 7, the tube 110 includes an end cap 60 attached to the tube at end 56 and is preferably one piece integral therewith. The end cap 60 has two like through bores 62.

Two like terminals 122, 122', FIG. 7, are attached to end cap 60 and pass through a corresponding mating bore 62. Each terminal 122, 122' comprises a conventional commercially available terminal stud 124. Stud 124 has a hexagonal head 126 and a threaded stem 128. The stud 124 has a through bore 130, FIG. 8. A U-shaped spring steel wire 134 has a leg 136 in a through bore in the head 126 on one side of the bore 130 and a leg 138 in a slot in the head on the other side of the bore 130 and in communication with the slot so that a portion of the leg 138 is in the bore 130 as shown. The threaded stem passes through the bore 62 in the tube end cap 60 into the chamber 66'.

An elongated insulated electrical conductor wire 142 is connected at one end to terminal 73 of the terminal assembly 69 preferably by soldering or by a terminal lug not shown. The other end of wire 142 is connected to a conventional ring-like connector lug 144. The lug 144 receives the stem 128 therethrough, FIG. 5. A nut 146 is attached to the stem 128 and locks the lug ohmically connected to the stem 128 and thus to the stud 124. In similar fashion, electrically conductive wire 148 is connected at one end to terminal 71 and at its other end to terminal 122', which is identical to terminal 122.

It should be appreciated that the terminals 122, 122' are given by way of example, as any terminal configuration may be attached to the cap such as cap 60. Numerous terminals are available commercially and may be utilized according to a given implementation. Such terminals merely require a metal electrical conductor be connected externally the tubes 70', 110 and the end cap 60 and be coupled to a through bore in the cap or tube(s) to permit an electrical conductor to pass therethrough for connection to the wires 142 and 148.

The assembly sequence for assembly 108 is that the wires 142 and 148 are first attached to the terminals 73 and 71, respectively, prior to attachment of the terminal assembly 69 to the tube 70' and casing 68. Next, the wires 142 and 148 are passed through the opening bore 93 in the bottom wall 74 portion 72 of tube 70' and casing 68. The terminals 71 and 73 including the rod 75, tube 79 and attached tube 81 are then inserted into the bore 93 formed by tube 70 and the casing 68. This may be a press interference fit between the tube 81, portion 72 and casing 85 and in addition, the solder joint 95 may also be formed at this time.

The other ends of the wires 142 and 148 are then attached to terminals 122, 122' previously assembled to the cap 60. The tube 110 with the terminals 122, 122' attached to the wires 142 and 148 is then inserted into the tube 70' chamber, FIG. 5. One or more screws 108 are then attached to the tubes 70' and 112 at apertures 106 and 116 and other similar apertures, if desired (not shown). The connector device 25 thus appears as shown in FIG. 5.

In FIG. 7, a mating connector 150 which is commercially available comprises a plastic housing 152 to which two metal terminals 154 are attached. The terminals 154 mate with and are inserted into the bores 130 of the studs 124 of the terminals 122, 122'. The terminals 154 have a curved ends 156 for easy insertion into the bores 130. The terminals engage the spring wire 134 in the studs 124 to provide good electrical ohmic contact therewith. The wires 134 also hold the terminals 154 to the studs 124. The terminals 154 are held rigidly in place by the housing 152 is spaced relation that corresponds to the spacing of the studs 124 in cap 60. The connector 150 is releasably connected to the studs 124.

The wires 158 of cable 4, FIG. 1, are soldered or otherwise ohmically and mechanically secured to terminals 154 inside of the housing 152 chamber 190. An epoxy potting material (not shown) may fill the chamber 190 to permanently secure the wires 158 to the connector 150. The other ends of the wires 154 are connected to the remote pyrotechnic device 6, FIG. 1.

In operation, one or more of the devices 25 are placed in any of the desired receptacles 26, FIG. 2, of the magazines 16, 18 and/or 20. The ignition signal applied to the device 25 is then transferred to the remote device 6, igniting the remote pyrotechnic device 6 in the desired sequence. That sequence may include any or all of flash, smoke of a given color and noise of a given intensity produced by the devices 24 ignited in that sequence. The device 25 is easily placed in any receptacle of any magazine providing great flexibility in transferring signals to the remote devices in any desired time frame relative to the ignition of the remaining pyrotechnic devices 24.

While the wires 142 and 148, FIG. 7, are shown as discrete Insulated conductors. In the alternative, the wires may be directly printed on or attached to the inner surface of the electrically insulating plastic tube 70' inside of the chamber. Terminals may be attached to the printed conductors. These latter terminals may be metal studs for example which pass through bores in a cap such as cap 60 to form terminals which are the equivalent of terminals 122.

Figure 11:
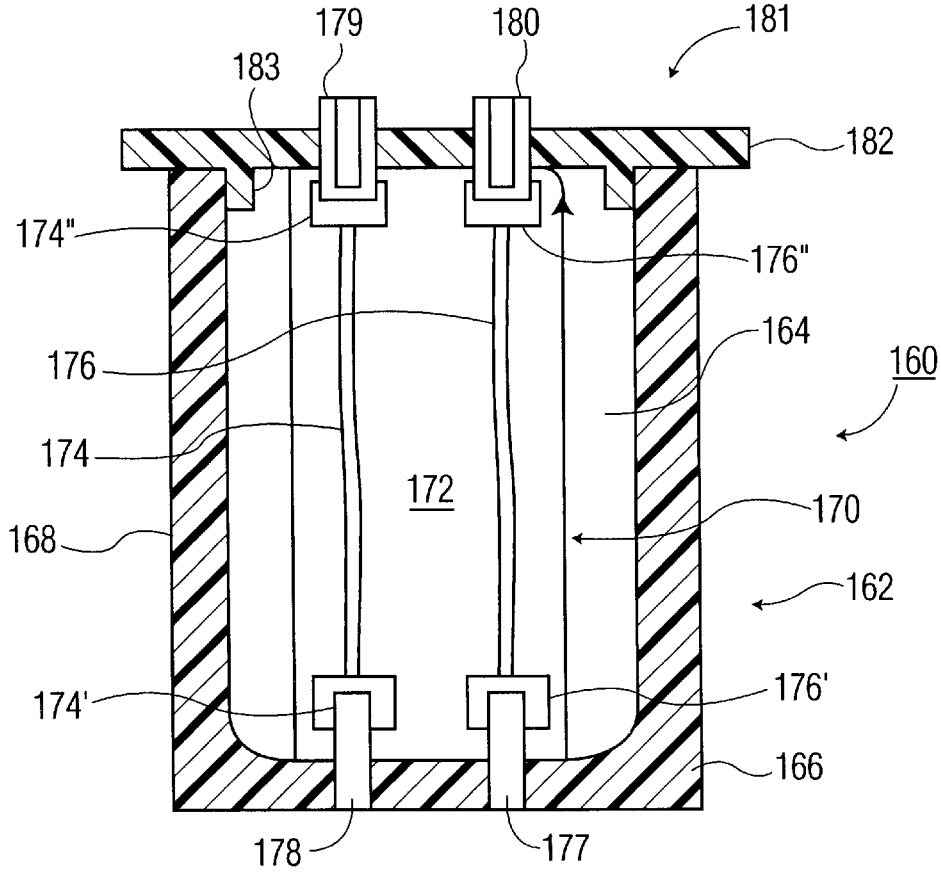
FIG. 11 is a sectional elevation view of the device of FIG. 10 taken along lines 11—11.

In a further embodiment, the conductors may be printed wire conductors on an insulating substrate board. In FIG. 11, device 160 comprises a thermoplastic tubular casing 162 having a chamber 164 defined by bottom wall 166 and side wall 168. Located in the chamber 164 is a printed circuit board assembly 170. The assembly 170 comprises an insulating printed board 172 on which are printed two circuit conductors 174 and 176. The conductor 174 terminates at conductive pads 174' and 174" at opposite conductor ends. Conductor 176 terminates at conductive pads 176' and 176" at opposite conductor ends.

A metal terminal 178, which may be a rod or other conventional terminal construction, is ohmically and mechanically secured to pad 174'. A metal terminal 177, which may be a rod or other conventional terminal construction, is ohmically and mechanically secured to pad 174'. Terminals 177 and 178 pass through the bottom wall 166 and may be press fit to the bottom wall to form a hermetic seal therewith. These terminals may be first assembled to the bottom wall and then soldered to the pads 174' and 176', for example. Terminals 179 and 180 are soldered for example to respective terminals 174" and 176" of the board 172. The terminals 179 and 180 have bores for receiving the terminals 154 of FIG. 7, for example. In the alternative, terminals such as terminals 122 of FIG. 7 may be attached to pads 174" and 176".

A cap 181 is then attached to the open end of the casing 162 to enclose the chamber 164. The cap has a flange 182 which is bonded to the upper edge of the casing 162 wall 168 and to the wall 168 upper inner surface at cap depending annular portion 183. As a result, all of the terminals and conductors are attached to a printed circuit board attached to the tube casing 162' and enclosed by the end cap 181. Thus the terminals attached to the printed circuit board extend therefrom to pass through bores in the bottom wall 166 and through the cap 181.

It is preferred that the chambers of the tubes and casings be hermetically sealed, but this is optional. Also, the terminals such as terminals 179 and 180, FIG. 11, do not necessarily have to be attached to the cap, but may be attached elsewhere, for example, to the side wall 168 in other embodiments wherein a tube such as casing 162 may extend beyond the magazine 16 since the device such as device 160 has no pyrotechnic material in its chamber and does not ignite. In this case, the terminals on the tube side wall such as wall 168 would be accessible externally the magazine 16. For this embodiment, the terminals such as terminals 179 and 180 would be attached to pads that terminate adjacent to the wall 168 and pass through the wall 168. A cap then seals the chamber after the terminals are in place. The terminals being preassembled to the printed circuit board are passed through appropriate apertures formed in the tubular casing walls. The device 160 may be used with an ignition apparatus such as disclosed by Dix U.S. Pat. No. 5,585,595 incorporated by reference herein in its entirety.

In the alternative. A metal outer casing as disclosed in the aforementioned patents '948 and '570 may be attached over the bottom wall 166 and ohmically connected to terminal 177 to form a ground contact that is usable with the apparatus of FIG. 2.

It will occur to one of ordinary skill that various modifications may be made to the disclosed embodiments which are given by way of illustration and not limitation as described above by way of example. It is intended that the scope of the invention is as defined by the appended claims.

What is claimed is:

1. A pyrotechnic ignition signal transfer connector device for use with a pyrotechnic ignition apparatus having first and second device ignition terminals comprising:

a housing having first and second opposing ends and a chamber;

third and fourth electrically conductively isolated terminals connected to the housing first end, each terminal for respective engagement with a different one of the pyrotechnic ignition apparatus first and second terminals; and fifth and sixth electrically conductively isolated electrical terminals secured to the housing distal the first end, the fifth terminal being electrically conductively connected to the third terminal and the sixth terminal being electrically conductively connected to the fourth terminals.

2. The device of claim 1 wherein the housing is thermoplastic.

3. The device of claim 1 wherein the first end includes a metal cap.

4. The device of claim 1 including a cap enclosing the housing chamber at the second end.

5. The device of claim 1 wherein the housing chamber is defined by a side wall and a bottom wall, the device including a cap enclosing the chamber at the housing chamber second end, the cap including a sleeve telescopically received in the chamber, and means for securing the cap to the housing.

6. The device of claim 5 wherein the sleeve overlies the housing at a side wall of the chamber, the means for securing including a fastener attached to the sleeve and housing.

7. The device of claim 1 wherein the fifth and sixth terminals each comprise a stud with a bore for ohmically receiving one of seventh and eighth terminals for transferring an ignition signal applied to the third and fourth terminals by the ignition apparatus to a remote pyrotechnic device connected to the seventh and eighth terminals, and means for attaching a corresponding stud to the housing.

8. The device of claim 7 wherein the housing chamber at the second end is enclosed by a cap, the studs each being attached to the cap.

9. The device of claim 1 wherein the housing is tubular with the first end enclosed, the third and fourth terminals passing through the enclosed first end.

10. A method of making the device of claim 1 comprising forming a tubular housing of thermoplastic material with at least one opening in the housing first end, forming the third and fourth terminals, attaching a first electrical conductor to the third terminal and a second electrical conductor to the fourth terminal, passing the first and second electrical conductors and a portion of the third and fourth terminals through said housing opening into the chamber, securing the third and fourth terminals to the housing first end, and then attaching the fifth terminal to first electrical conductor distal the third terminal and the sixth terminal to the second electrical conductor distal the fourth terminal, and then securing the fifth and sixth terminals to the housing second end and enclosing the chamber at the housing second end.

11. A pyrotechnic ignition apparatus comprising:

a magazine;

a plurality of devices secured to the magazine;

at least one first of said devices for simulating at least one of flash, smoke or noise when ignited, ignition means for receiving the magazine and for selectively igniting the secured devices individually with an associated applied ignition signal;

at least one second of said devices including first terminals for receiving said ignition signal and including second terminals distal the first terminals and ohmically connected to the first terminals for transferring the ignition signal to the second terminals.

12. The apparatus of claim 11 including a further pyrotechnic device; the further device including third terminals and arranged to be remotely positioned relative to said magazine, the further device including conductor means for ohmically connecting the third terminals to the second terminals, the third terminals being arranged to releasably mate with and electrically couple to the second terminals for applying said ignition signal to said further device.

13. The apparatus of claim 11 wherein the ignition means includes means for igniting the devices in a given sequential order.

14. A method of forming an electrical connection device comprising:

forming a tubular housing with a chamber and opposing ends, the housing having a bottom wall and an annular side wall, the bottom wall being at one end of the housing and having at least one through opening in communication with the chamber, forming first and second terminals;

attaching a first electrical conductor to the first terminal;

attaching a second electrical conductor to the second terminal;

passing the first and second electrical conductors through the at least one through opening into the chamber;

securing the first and second terminals to the housing bottom wall in said at least one opening;

forming a cap for enclosing the chamber;

attaching third and fourth terminals to the cap, the third and fourth terminals passing through the cap in communication with opposing cap sides, the third and fourth terminals for being ohmically connected to an electrical connector;

ohmically coupling the first electrical conductor to the third terminal and ohmically coupling the second electrical conductor to the fourth terminal; and attaching the cap to the housing over the chamber end opposite the bottom wall with the third and fourth terminals in communication with the chamber and ambient atmosphere.

15. An electrical connector for receiving and transferring an electrical signal applied to first and second terminals comprising:

a tubular housing having first and second opposing ends, and a bottom wall at the first end forming a chamber;

third and fourth electrically conductively isolated terminals connected to the housing bottom wall in communication with the chamber, each terminal for respective releasable engagement with a different one of and mating with the first and second terminals for receiving the applied electrical signal;

a first conductor connected to the third terminal and located in the chamber and a second conductor connected to the fourth terminal and located in the chamber;

a cap enclosing the housing second end;

fifth and sixth electrically conductively isolated electrical terminals secured to one of the housing and the cap, the fifth terminal being electrically conductively connected to the first conductor and the sixth terminal being electrically conductively connected to the second conductor whereby the electrical signal is applied to the fifth and sixth terminals.

16. The connector of claim 15 wherein the fifth and sixth terminals are secured to the cap and include a portion extending externally the cap.

17. The connector of claim 15 wherein the fifth and sixth terminals pass through the one of the housing and cap into the chamber.

18. The connector of claim 15 wherein the fifth and sixth terminals are substantially identical.

19. The connector of claim 15 wherein the fifth and sixth terminals each have a cap portion and a stem portion, the stem portion being threaded and located in the chamber, and a nut attached to the stem portion for locking the fifth and sixth terminals to the cap.

20. The connector of claim 15 wherein the fifth and sixth terminals each have a bore for receiving a further terminal.

* * * * *